US005397125A

United States Patent [19]

Adams

[11] Patent Number: 5,397,125

[45] Date of Patent: Mar. 14, 1995

[54] GAMING DEVICE WITH PAYOUTS OF MULTIPLE FORMS

[75] Inventor: William R. Adams, Las Vegas, Nev.

[73] Assignee: Anchor Coin, Inc., Las Vegas, Nev.

[21] Appl. No.: 168,011

[22] Filed: Dec. 15, 1993

[51] Int. Cl.[6] ..... A63F 1/00

[52] U.S. Cl. ..... 273/138 A; 273/138 R; 273/139; 273/85 CP; 364/412

[58] Field of Search ..... 273/138 A, 85 CP, 143 R, 273/858, 139; 364/412, 411, 410

[56] References Cited

U.S. PATENT DOCUMENTS

| | | | |
|---|---|---|---|
| 4,689,742 | 8/1987 | Troy et al. | 364/412 |
| 4,743,024 | 5/1988 | Helm et al. | 273/143 R |
| 5,016,880 | 5/1991 | Berge | 273/138 A |
| 5,050,881 | 9/1991 | Nagao | 273/143 R |
| 5,067,712 | 11/1991 | Georgilas | 273/143 R |
| 5,135,224 | 8/1992 | Yamamoto et al. | 273/143 R |
| 5,178,390 | 1/1993 | Okada | 273/143 R |
| 5,221,083 | 6/1993 | Dote | 273/85 CP |
| 5,290,033 | 3/1994 | Bittner et al. | 273/138 A |

FOREIGN PATENT DOCUMENTS

| | | | |
|---|---|---|---|
| 8002512 | 11/1980 | WIPO | 273/138 A |
| 8500910 | 2/1985 | WIPO | 273/143 R |

*Primary Examiner*—Vincent Millin
*Assistant Examiner*—Kerry Owens
*Attorney, Agent, or Firm*—Galgano & Burke

[57] ABSTRACT

A gaming device is provided which supplies winning players with the opportunity to receive payouts in at least two distinct forms, both of which are inherently valuable. One form of winning payout comprises a national currency, such as U.S. quarters, while another form of payout comprises tokens formed of a precious metal such as silver and/or gold.

18 Claims, 2 Drawing Sheets

GAMING DEVICE WITH PAYOUTS OF MULTIPLE FORMS

The present invention is directed to gaming devices and, more particularly, to gaming devices capable of providing at least two different forms of prizes that are inherently valuable.

BACKGROUND OF THE INVENTION

Games of chance have been enjoyed by people for thousands of years and have enjoyed widespread popularity in recent times. Many people enjoy playing a wide variety of games that they have not played before. Playing new games adds to the excitement of this recreational activity.

One popular game of chance that has long been enjoyed by many players is the slot machine. Conventionally, a slot machine is configured for a player to input a standard denomination of currency and then to permit the player to activate a lever or push a button which causes a plurality of reels to spin and ultimately stop to display a random combination of some form of indicia, for example, numbers or symbols. If this display contains one of a preselected plurality of winning combinations, the machine releases money into a payout chute or onto a credit meter for the player. For example, if a player initially wagered two coins of a national currency and that player won a high payout, that player may receive fifty coins of the same denomination in return.

As a safeguard against tampering with machines and in order to keep some order in a gaming establishment such as a casino, it has also been suggested that when a player wins a large jackpot at a slot machine, instead of receiving a very large number of coins from the machine, the machine prints out a check or a ticket to the player which is redeemable at a cashier window at that casino. While this method of making relatively large payments offers some advantages, it also suffers several disadvantages. One distinct disadvantage is that this method of payment deprives the player of the immediate gratification of collecting the winnings. Secondly, the player must leave the machine in order to collect the winnings. Those familiar with the gaming industry will appreciate that it is in the gaming establishment's best interest to allow a player to play continuously at a gaming device without interruption since the overall profit to the gaming establishment is proportional to the amount of play that such gaming devices receive. If a player is required to leave a specific slot machine in order to collect a payout at another location, the player may not return to play the game.

It would therefore be desirable to provide a player with an attractive prize without requiring the player to leave the gaming device.

It would also be desirable to provide players with novel forms of prizes having inherent value which will be attractive to a wide variety of players and therefore encourage players to play the game.

Other disadvantages of conventional gaming devices is that they simply provide payouts in the form of a national currency, a credit or a check in that national currency. Therefore, when the player's excursion to the gaming establishment is over, the player will typically do a calculation of how much money was started with compared to how much money the player leaves with and thereby determine whether the trip was "successful". If a player leaves with less money than the player started with, the player may deem the otherwise entertaining recreational activity to have been unrewarding. It is therefore desirable to provide players with another form of prize that has inherent value in a form other than a national currency which can provide a player with a feeling of "success" without depriving the gaming establishment of a profit.

It is also desirable to provide such prizes in a form which will serve as a reminder to the player and other people seeing the prize, of the player's enjoyable experience.

SUMMARY OF THE INVENTION

The present invention advantageously provides a gaming device, most preferably in the form of a slot machine, which provides players with prizes in a first, inherently valuable form when a player achieves one level of success and with prizes in a second, inherently valuable form when a player achieves another level of success. Preferred forms of the present invention provide prizes to a winning player in an inherently valuable form at the gaming device and, therefore, do not require the player to interrupt an enjoyable gaming experience in order to collect a winning payout.

One preferred embodiment of the present invention comprises a slot machine which requires the insertion of some form of value before allowing a player to activate the "pull-down" lever or spin button. After the player has deposited the desired wager and activated the lever, the machine randomly generates a display which is compared to a preselected plurality of winning options. If the display obtained by the player matches one of the preselected plurality of winning options, the player receives a valuable prize. According to the various embodiments of the present invention, at least one of said winning displays results in the player receiving a prize in a first form which has inherent value, such as the same currency which the player used to make wager, and at least one other winning display results in the player receiving a prize in a form which has inherent value but is different from the first form. For example, if the first form of winning payout having inherent value comprises a national currency such as U.S. quarters, the second form of winning payout having inherent value can be tokens formed of a precious metal such as substantially pure silver. For purposes of convenience and in order to minimize the amount of time and effort required to the operate a gaming device of the present invention, it is preferred that the first form of winning payout is in the same form as the player has input. Those skilled in the art will appreciate that such an arrangement will reduce the frequency at which the gaming device must be stocked with that form of winning payout.

According to another embodiment of the present invention, more than two forms of winning payouts having inherent value are provided for players that obtain winning options. For example, in addition to the currency and silver tokens provided for different levels of success as described in the embodiment above, a third form of winning payout having inherent value such as gold tokens may be provided to a player receiving a winning option that is even higher than the winning option that pays a prize in the form of a silver token.

In another embodiment of the present invention at least some of the prizes having inherent value are in the form of souvenir tokens that are formed at least partially of a precious metal and are further provided with indicia of the precious metal content of the token, indicia of the operator of the gaming device, and/or indicia of a trade-in value of the token for players that do not wish to retain the token as a souvenir. Such souvenir tokens are most preferably provided to a winning player in a transparent capsule that will protect the polished finish of said tokens while serving as an attractive display case which reminds the player of the successful game and simultaneously advertises the name of the casino where the player won the precious metal token.

According to an alternative embodiment of the present invention, at least one of the forms of winning payout having inherent value is provided for a plurality of winning options. Thus, in a slot machine embodiment a player may receive one coin of a national currency for achieving any of several levels of success and a silver token for a different level of success.

These and other embodiments are described in further detail below with reference to the drawings.

DETAILED DESCRIPTION

The present invention comprises gaming devices and methods of playing a game wherein a wager is received in at least one form from a player. A plurality of indicia are randomly displayed to the player wherein the odds of the player receiving one display is one value and the odds of a player receiving another display is a different value. The random display is compared to a preselected plurality of winning combinations and if the player has received a winning combination, the player is advantageously provided with a winning payout. According to the various embodiments of the present invention, the payouts available to a player may be in a first form having inherent value if the odds of obtaining that winning combination are of a first value. Alternatively, the player is provided with a prize in a second form having inherent value if the odds of obtaining that corresponding display of indicia is a second value different from the first value. While the advantages of the present invention can be enjoyed on a variety of gaming devices, the invention is described herein with reference to a slot machine shown in FIG. 1.

Figure 1:
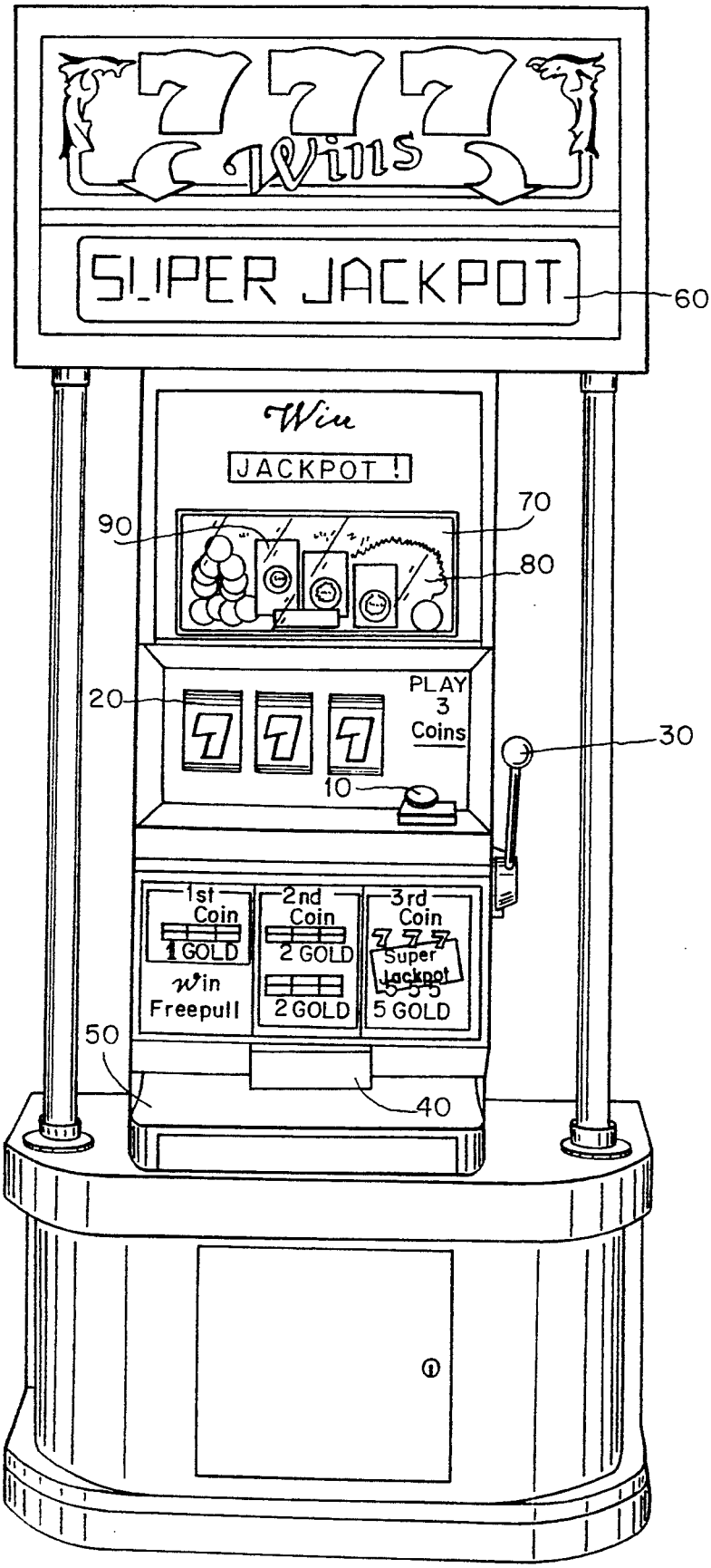
FIG. 1 is a perspective view of one preferred embodiment of the present invention.

The illustrated embodiment shown in FIG. 1 comprises a coin slot 10, a display area 20, an activation handle 30, a payout chute 40, a collection trough 50, an electronic sign 60 and a display window 70. In a manner known in the art, the illustrated slot machine also advantageously provides some instructions to the player and some indication of possible prizes. According to this preferred illustrated embodiment, display window 70 indicates at least one preferred form of prize available to winners. In the illustrated embodiment, display window 70 comprises precious metal tokens 80, such as the tokens shown in FIGS. 2–4, at least some of which are displayed within protective transparent capsules 90.

According to the illustrated preferred embodiment of the present invention, winning payouts are provided to a player achieving certain levels of success in the same form as the player deposited into coin slot 10 in order to be able to activate handle 30. For example, if the gaming device is designed to receive national currency, such as U.S. quarters, then at least one and preferably more than one of the possible winning combinations will provide payouts to a winning player in the form of that national currency. If the player achieves another level of success, preferably a winning combination which is less likely to be obtained than the winning combinations which paid out in the national currency, than the player is provided with the second form of prize having inherent value.

According to the various embodiments of the present invention, a player is provided with an opportunity of receiving at least two forms of winning payout which are inherently valuable. As used herein, the term "inherently valuable" is used to indicate that the prize has a value in society separate and distinct from any value that it may have at the particular gaming establishment at which the player has won the prize. For example, it will be appreciated that a national currency has value outside of the gaming establishment, as does a token formed of a precious metal such as silver or gold. On the contrary, games previously known in the art which provided a payout stub redeemable only with the owner of the gaming device and which would have no other value apart from redemption with that owner, would not be considered "inherently valuable" as that term is used herein.

FIGS. 2–5 illustrate some forms of precious metal tokens that may be provided in accordance with the present invention in addition to a first form of prize which may be a national currency. As illustrated, the illustrated precious metal tokens advantageously comprise several indicia which make them attractive to players. For example, some of the precious metal tokens comprise indicia of the precious metal content of the token, for example "0.999 fine silver". The tokens also comprise indicia of the gaming establishment. Since these precious metal tokens are designed to be attractive, these tokens provide an attractive keepsake for a winning player as well as a reminder of the player's experience and the casino where the player enjoyed the good fortune of winning. Thus, the form of prize illustrated in FIGS. 2–5 are also attractive to casinos in that, to the extent that they are retained by a player, they serve as an attractive advertisement for the casino.

While it is contemplated that a certain percentage of players will retain the second form of winning prize, such as those illustrated in FIGS. 2–5, other players may wish to have a prize that is in the form of a national currency. Therefore, the present invention advantageously provides such players with the option of redeeming the inherently valuable tokens for a national currency. Such redemption can be performed either at a cashier's window in a manner known in the art or, alternatively, could be accomplished with a device similar to a change machine wherein the player deposits the precious metal token and receives payment in a national currency. Such a machine could be located proximate the gaming device. From the above description, those of ordinary skill in the art will appreciate that the various embodiments of the present invention provide winning players with an opportunity to take a souvenir from the gaming establishment which can be enjoyed and shown to the player's friends, for many years following the winning event. In order to increase the attractive life of the precious metal payout token of the illustrated embodiment and to further encourage players to retain the tokens, these tokens are provided to the player in a transparent protective capsule 90 in order to protect the token from dirt and scratches which would make the token less attractive.

Since it is within the level of skill of those trained in the gaming device industry to provide necessary hardware, glassware and control circuitry to the slot machine illustrated in FIG. 1, further detailed description is not provided herein. For example, suitable controls and a plurality of payout chutes which will release the desired form and number of payouts to a winning player will be utilized.

Figure 2:
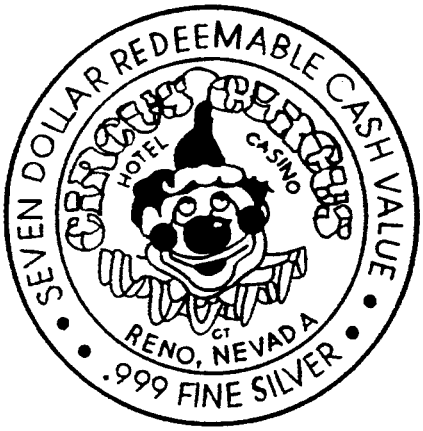
FIGS. 2–5 illustrate preferred forms of winning payouts of one embodiment of the present invention.
Figure 3:
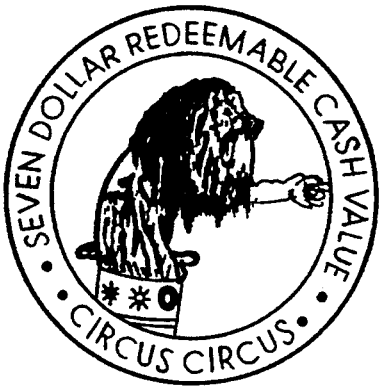
Figure 4:
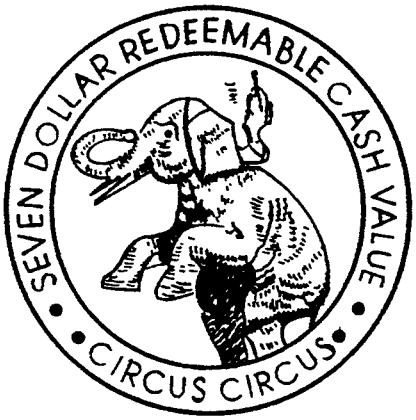
Figure 5:
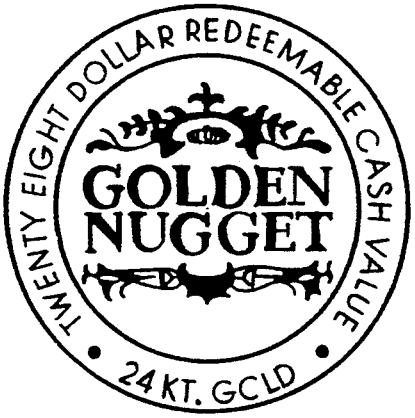

It is also contemplated within the scope of the present invention that a given form of payout provided by a gaming device may comprise different indicia such as the different indicia illustrated in FIGS. 2–4.

For purposes of illustration, and without limiting the scope of the present invention, the following is one example of a payout schedule that may be utilized with one embodiment of the present invention.

| Winning Indicia | Value | Actual Payout |
|---|---|---|
| Top Award | 200 | Jackpot Pay |
| Triple Bars | 120 | Three $10.00 tokens |
| Double Bars | 80 | Two $10.00 tokens |
| Single Bars | 40 | One $10.00 token |
| Three Cherries | 20 | 20 quarters |
| Two Cherries | 10 | ten quarters |
| One Cherry | 5 | five quarters |
| Any Bars | 2 | two quarters |

It is preferred that the different forms of winning payouts will correspond to the odds of obtaining the specific winning display. For example, the national currency used by the player to activate the machine may be paid out for any display wherein the chance of that display occurring is one in fifty or greater. Another form of payout, such as a substantially pure silver token, may be provided for payouts having less than a one in fifty chance of occurring. While this is preferred, other payout arrangements are possible without departing from the scope of the present invention. It is also within the scope of the present invention to provide more than two forms of winning payout such that a single machine could provide a form of national currency, silver tokens, as well as a gold token such as the token illustrated in FIG. 5.

What is claimed is:

1. A gaming device comprising:

means for receiving a wager in at least one form;

means for randomly displaying a plurality of indicia wherein the odds of said random displaying means displaying at least one plurality of indicia is less than the odds of said random displaying means displaying some other plurality of indicia;

means for comparing said displayed indicia with a preselected plurality of winning combinations of indicia;

means for providing a winning payout if said displayed indicia matches at least one of said preselected winning combinations wherein said payout is in a first form having inherent value if the odds of obtaining said payout are less than a predetermined value and said payout is in a second form having inherent value if the odds of obtaining said payout are greater than said predetermined value, said payouts having a value in society separate and distinct from any value that said prizes may have at the particular gaming establishment at which a player has won one of said payouts.

2. A gaming device according to claim 1 wherein said first form of said payout is identical to a form of a wager received by said wager receiving means.

3. A gaming device according to claim 2 wherein said second form of said payout comprises a token comprising a precious metal.

4. A gaming device according to claim 1 wherein said second form of said payout comprises a token comprising a precious metal.

5. A gaming device according to claim 4 wherein said second form of said payout comprises a token comprising indicia of the precious metal content of said token.

6. A gaming device according to claim 4 wherein said second form of said payout comprises a token comprising indicia of a trade-in value of said token.

7. A gaming device according to claim 4 wherein said second form of said payout comprises a token comprising indicia of the location of said gaming device.

8. A gaming device according to claim 4 wherein said second form of said payout is provided to a player within a protective cover.

9. A gaming device according to claim 1 further comprising at least a third form of winning payout having inherent value which is different from said second form of winning payout.

10. A gaming device according to claim 1 wherein said first form of winning payout comprises a coin of a national currency, said second form of winning payout comprises a token formed substantially of a first precious metal and wherein said gaming device comprises at least a third form of winning payout comprising a token comprising a second precious metal which is different from said first precious metal.

11. A gaming device according to claim 10 wherein said first precious metal is silver and said second precious metal is gold.

12. A gaming device according to claim 1 wherein said first form of winning payout comprises a coin of a national currency, said second form of winning payout comprises a token formed substantially of a first precious metal and wherein at least some tokens of said second form comprise first indicia and other tokens of said second form do not comprise said first indicia.

13. A gaming device according to claim 1 wherein said gaming device is a slot machine.

14. A gaming device comprising:

means for receiving a wager in at least one form;

means for randomly displaying a plurality of indicia wherein the odds of said random displaying means displaying at least one plurality of indicia is less than the odds of said random displaying means displaying some other plurality of indicia;

means for comparing said displayed indicia with a preselected plurality of winning combinations of indicia;

means for providing a winning payout if said displayed indicia matches at least one of said preselected winning combinations wherein said payout is in a first form having inherent value if the odds of obtaining said payout are equal to a first predetermined value and said payout is in a second form having inherent value if the odds of obtaining said payout are equal to a second predetermined value, said payouts having a value in society separate and distinct from any value that said prizes may have at the particular gaming establishment. at which a player has won one of said payouts.

15. A gaming device according to claim 14 wherein said first form of said payout is identical to a form of a wager received by said wager receiving means.

16. A gaming device according to claim 14 further comprising a display of at least one of said forms of winning payout.

17. A gaming device according to claim 16 wherein said gaming device displays precious metal tokens.

18. A gaming device according to claim 17 wherein said displayed precious metal tokens comprise indicia of the precious metal content of the tokens and indicia corresponding to the gaming establishment.

* * * * *